US010151546B2

(12) United States Patent
Baker et al.

(10) Patent No.: US 10,151,546 B2
(45) Date of Patent: Dec. 11, 2018

(54) SHOTGUN WITH MAGAZINE LOADING SYSTEM

(71) Applicant: RA Brands, L.L.C., Madison, NC (US)

(72) Inventors: Travis T. Baker, Elizabethtown, KY (US); Justin C. Quackenbush, Madison, AL (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 15/002,080

(22) Filed: Jan. 20, 2016

(65) Prior Publication Data

US 2016/0298918 A1 Oct. 13, 2016

Related U.S. Application Data

(60) Provisional application No. 62/178,360, filed on Apr. 8, 2015.

(51) Int. Cl.

| | |
|---|---|
| ***F41A 11/02*** | (2006.01) |
| ***F41A 9/65*** | (2006.01) |
| ***F41A 9/71*** | (2006.01) |
| ***F41C 7/02*** | (2006.01) |

(52) U.S. Cl.

CPC ..... *F41A 9/65* (2013.01); *F41A 9/71* (2013.01); *F41A 11/02* (2013.01); *F41C 7/02* (2013.01)

(58) Field of Classification Search

CPC ..... F41A 9/61; F41A 9/64; F41A 9/65; F41A 9/66; F41A 9/68; F41A 9/70; F41A 9/72; F41A 3/64; F41A 3/66; F41A 11/02; F41C 7/00; F41C 7/02; F41C 7/04

USPC ..... 42/6, 16, 17, 18, 19, 25, 49.01, 49.02, 42/106; 89/33.01, 33.03, 33.1, 33.5

See application file for complete search history.

(56) References Cited

U.S. PATENT DOCUMENTS

| | | | | |
|---|---|---|---|---|
| 2,418,946 A * | 4/1947 | Loomis | F41A 3/40 42/16 |
| 2,538,173 A | 1/1951 | Swebilius | |
| 2,642,688 A | 6/1953 | Johnson, Jr. | |
| 2,736,117 A * | 2/1956 | Clarkson et al. | F41A 11/00 42/75.02 |
| 3,711,981 A | 1/1973 | Seecamp | |

(Continued)

FOREIGN PATENT DOCUMENTS

| | | |
|---|---|---|
| EP | 972167 A1 | 1/2000 |
| WO | WO 2008-118504 A2 | 10/2008 |
| WO | WO 2013-109999 A1 | 7/2013 |

*Primary Examiner* — Jonathan C Weber

(74) *Attorney, Agent, or Firm* — Womble Bond Dickinson (US) LLP

(57) ABSTRACT

A firearm including a barrel, a receiver, a magazine well and a magazine can be provided. The barrel may include a breech end at which a chamber is provided. The receiver can include a forward end coupled to the breech end of the barrel and a first side having an ejection port. Further, the receiver may have a bolt movable therealong, with the bolt including a stripping lug removably attached thereto. The magazine well that can be received along and mounted externally to the receiver may include an attachment portion for attaching the magazine well to the receiver, a magazine release latch, and a feed ramp. This feed ramp may include a body that is removably mounted to an existing tubular magazine, in front of the magazine well. A magazine loading system for converting a conventional shotgun into a magazine loaded shotgun may further be provided.

12 Claims, 16 Drawing Sheets

(56) References Cited

U.S. PATENT DOCUMENTS 3,952,441 A 4/1976 Tant
4,057,003 A 11/1977 Atchisson
4,079,535 A 3/1978 Elbe et al.
4,128,042 A 12/1978 Atchisson
4,139,958 A 2/1979 Foote
4,297,800 A 11/1981 Atchisson
4,506,038 A 3/1985 Gagliani et al.
4,515,064 A 5/1985 Hohrein
4,805,333 A 2/1989 Doria et al.
4,856,410 A 8/1989 Anderson
4,864,758 A * 9/1989 Crossman ..... F41A 9/23 42/18
4,867,039 A 9/1989 Dobbins
4,893,547 A 1/1990 Atchisson
4,905,395 A 3/1990 Wagner
4,912,868 A 4/1990 Thompson
5,027,541 A 7/1991 Velezis
5,054,221 A 10/1991 Ozols
5,056,252 A 10/1991 Velezis
5,099,595 A 3/1992 Chesnut et al.
5,119,575 A 6/1992 Gajdica
5,127,178 A 7/1992 Sinclair
5,157,210 A 10/1992 Davis
5,416,998 A 5/1995 Martel
5,442,874 A 8/1995 Findlay
5,452,533 A * 9/1995 Bentley ..... F41C 7/02 42/17
5,456,153 A 10/1995 Bentley et al.
5,561,258 A 10/1996 Bentley et al.
5,600,083 A 2/1997 Bentley et al.
5,664,355 A 9/1997 Ronkainen
5,755,052 A 5/1998 Kenney
5,761,841 A 6/1998 Snick
5,771,620 A * 6/1998 Crawford ..... F41A 9/41 42/19
5,870,846 A 2/1999 Ledford
5,956,878 A 9/1999 Yang
6,032,395 A * 3/2000 Bentley ..... F41A 9/41 42/19
6,070,352 A 6/2000 Daigle
6,164,000 A 12/2000 Lumplecker et al.
6,257,115 B1 7/2001 Balsavage et al.
6,367,188 B1 4/2002 Vargas
6,606,811 B1 8/2003 Olson
6,912,806 B2 * 7/2005 Malindretos ..... F41C 7/02 42/17
7,318,294 B2 1/2008 Zimmermann
7,441,491 B2 10/2008 Snow
7,444,775 B1 11/2008 Schuetz
7,533,483 B1 5/2009 Alzamora et al.
7,533,598 B1 5/2009 Murphy
7,735,252 B1 6/2010 Laney et al.
7,806,036 B2 10/2010 Cook et al.
7,854,083 B1 12/2010 Aalto
7,866,079 B2 1/2011 Kenney et al.
7,921,587 B2 4/2011 Mayberry
7,942,091 B2 5/2011 Winge
7,958,660 B2 6/2011 Fitzpatrick et al.
8,037,800 B2 10/2011 Snow
8,104,209 B1 * 1/2012 Bentley ..... F41A 9/59 42/49.01
8,122,632 B2 2/2012 Bentley
8,322,063 B1 12/2012 Battaglia
8,353,123 B2 1/2013 Pullicar et al.
8,397,617 B2 3/2013 Shirts et al.
8,418,390 B1 * 4/2013 Wright ..... F41A 9/61 42/49.01
8,429,844 B2 4/2013 Dextraze et al.
8,485,083 B1 7/2013 Care
8,522,465 B2 9/2013 Jarboe et al.
8,667,723 B2 3/2014 Bentley et al.
8,689,475 B2 4/2014 Battaglia
8,726,554 B2 5/2014 Klassen
8,733,007 B2 5/2014 Hatfield
8,756,845 B2 6/2014 Harris et al.
8,756,846 B1 * 6/2014 Lemoine ..... F41C 7/02 42/69.01
8,789,302 B1 7/2014 Pietrzyk
8,820,212 B2 9/2014 Rostocil
8,832,987 B2 9/2014 Addis
8,839,541 B1 9/2014 Karfiol et al.
8,863,422 B2 10/2014 Ballard
9,080,822 B2 * 7/2015 Lamb ..... F41A 9/01
9,091,500 B1 7/2015 Kim et al.
9,103,612 B2 * 8/2015 Foster ..... F41A 9/55
9,115,951 B2 8/2015 Bentley
9,207,029 B2 12/2015 Klarborg
9,228,788 B1 1/2016 Simon et al.
9,267,748 B2 2/2016 Thordsen
9,310,159 B1 4/2016 Lemoine
2003/0167672 A1 * 9/2003 Makindretos ..... F41C 7/02 42/17
2005/0217160 A1 10/2005 Kaewpinyo
2006/0048426 A1 3/2006 Crandall
2007/0107592 A1 5/2007 Snow
2008/0028659 A1 2/2008 Moretti
2011/0005114 A1 1/2011 Snow
2011/0099876 A1 5/2011 Bentley
2011/0214326 A1 9/2011 Inskeep et al.
2013/0047831 A1 2/2013 DeJong
2014/0068986 A1 3/2014 Pietrzyk et al.
2014/0075808 A1 3/2014 Ballard
2014/0137453 A1 * 5/2014 Lamb ..... F41A 9/01 42/6
2014/0190052 A1 * 7/2014 Lemoine ..... F41C 7/02 42/6
2014/0196340 A1 7/2014 Dugger
2014/0237878 A1 8/2014 Lambert
2014/0250751 A1 * 9/2014 Foster ..... F41A 9/55 42/6
2014/0283673 A1 9/2014 DeJong
2014/0317983 A1 10/2014 Bush
2014/0325886 A1 11/2014 Mather
2015/0068096 A1 3/2015 Addis
2015/0176938 A1 6/2015 Micklethwaite
2015/0316337 A1 11/2015 Alkhalaileh et al.
2015/0362271 A1 12/2015 Foster

* cited by examiner

SHOTGUN WITH MAGAZINE LOADING SYSTEM

CROSS REFERENCE TO RELATED APPLICATIONS

The present Patent Application is a formalization of previously filed, U.S. Provisional Patent Application Ser. No. 62/178,360, filed Apr. 8, 2015 by the inventors named in the present Application. This Patent Application claims the benefit of the filing date of this cited Provisional Patent Application according to the statutes and rules governing provisional patent applications, particularly 35 U.S.C. § 119(e), and 37 C.F.R. §§ 1.78(a)(3) and 1.78(a)(4). The specification and drawings of the Provisional Patent Application referenced above are specifically incorporated herein by reference as if set forth in their entirety.

TECHNICAL FIELD

The present disclosure relates generally to firearms and, in particular, to a box magazine loading system for use with shotguns.

BACKGROUND

Conventional pump-action shotguns have been popular among sportsmen for hunting and sport shooting (e.g., of clay pigeons), and have various uses ranging from home defense to law enforcement applications. Typically, these designs include a fixed magazine tube which generally holds a limited number of shotgun cartridges. After all of the cartridges are fired, a next series of cartridges must be loaded one at a time into the tubular magazine. This can be a time consuming process, and under hostile conditions, such as in combat or other, similar situations, however, the time necessary to reload a weapon can be critical.

Moreover, some shotgun owners are increasingly choosing to modify or upgrade their existing weapons with new accessories and parts, as opposed to purchasing a new weapon. Some firearm owners also routinely modify their weapons to suit a particular interest, look, or to accomplish a desired function. For example, under circumstances such as police work and military applications, it would be desirable to have a pump action shotgun with the capability to be more rapidly reloaded with ammunition, or to be provided with increased ammunition capacities.

Accordingly, there exists a need for a shotgun magazine loading system to allow a user to rapidly fire and reload ammunition, such as via a removable/replaceable magazine. It is to the provision of a solution to this and other problems that the present disclosure is primarily directed.

SUMMARY

Generally described, the present disclosure relates to a system for enabling firearms having tubular magazines to accept replaceable box, drum or other, similar magazines. In one embodiment, the firearm will include a shotgun comprising a barrel, a receiver, a magazine well, and a magazine. The barrel generally has a breech end at which a chamber is provided, and to which the receiver is coupled. The receiver will have a bolt movable internally therealong, and a bottom, a first side surface, and a second side surface. The magazine well is received along and mounts to the bottom and side walls of the receiver with the holes for attachment perpendicular to the side walls of the receiver, and includes a body having an attachment portion for attaching the magazine well to the receiver and a magazine release latch. A feed ramp can be removably mounted to the existing tubular magazine, generally located in front of the magazine well and attached to the magazine tube such as by a fastener that also can be used to mount the magazine well body along the receiver. The feed ramp can have a body with a ramped upper portion configured for directing cartridges into the chamber of the firearm from the magazine. A magazine, which can comprise a box, drum, or other replaceable type magazine is insertable into the magazine well, and can be configured to engage the magazine release latch. The magazine further in a preferred embodiment includes feed lips, but could include a cut-out portion adapted to contact the rim of a shell and direct the shell upward and into the chamber of the shotgun in other embodiments.

In another aspect, the disclosure generally is directed to a magazine loading system for a shotgun having a tubular magazine into a shotgun configured to receive a removable, external magazine. The magazine loading system comprises a magazine well, a magazine, a stripping lug, and a feed ramp. The magazine well has a body with an attachment portion configured for removably fitting/mounting to the receiver of the shotgun, and a magazine release latch. The feed ramp is mountable within the existing magazine tube of the shotgun and has a body with an upper portion configured for directing cartridges into a chamber of the shotgun. The receiver will have a bolt having a bottom surface, a first side surface and a second side surface, and can be provided with a stripping lug, which can be removably attached to at least one of the bottom surface, first side surface and second side surface of the bolt. The magazine further can have feed lips and protrusions configured to contact the rim of a shell.

Other structures and techniques, and modifications and/or changes thereto employed to improve over the drawbacks of the prior devices and accomplish the advantages described herein will become apparent from the following detailed description of representative embodiments and the appended drawings and claims.

Figure 1:
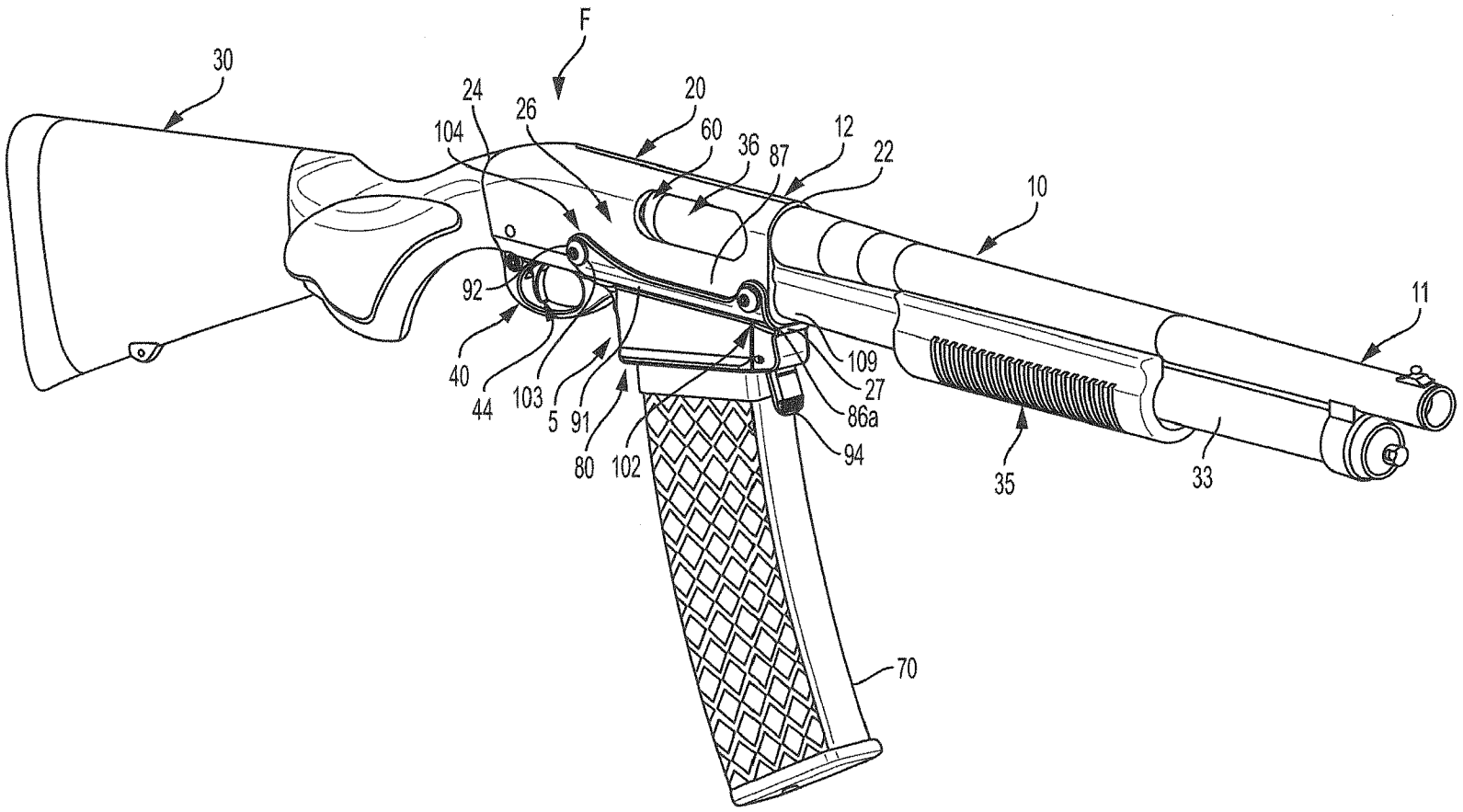
FIG. 1 is a perspective view of a shotgun including the magazine loading system according to one embodiment of this disclosure.

Those skilled in the art will appreciate and understand that, according to common practice, various features of the drawings discussed below are not necessarily drawn to scale, and that dimensions of various features and elements of the drawings may be enlarged or reduced to more clearly illustrate the embodiments of the present invention described herein.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the invention. The examples used herein are intended merely to facilitate an understanding of ways in which embodiments of the invention may be practiced and to further enable those of skill in the art to practice the embodiments disclosed herein. Accordingly, the examples and embodiments herein should not be construed as limiting the scope of the invention, which is defined solely by the appended claims and applicable law.

DETAILED DESCRIPTION

It is to be understood that the invention of the present disclosure is not limited to the specific devices, methods, conditions, or parameters of the representative embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

Generally described, the present disclosure relates to a magazine loading system 5 for enabling the use of replaceable, externally mountable magazines with firearms, such as a rifle or shotgun. In one embodiment, the magazine loading system 5 can be provided part of a firearm, such as a shotgun, or in other embodiments the magazine loading system can be used with a shotgun or other firearm having a tubular magazine (e.g., Remington model 870®), such that the shotgun is configured to receive a box, drum or other type of removable, externally mounted magazine. The firearm and magazine loading system of the present disclosure provides several significant advantages and benefits over other systems and methods for loading rounds of ammunition into shotguns and various other, similar firearms; however, the recited advantages are not meant to be limiting in any way, as one skilled in the art will appreciate that other advantages may also be realized upon practicing the present disclosure.

As illustrated in FIGS. 1-12, the magazine loading embodiments of the presently disclosed system 5 and components thereof are shown in use with a firearm F, such as a shotgun comprising a barrel 10, a receiver 20, and a stock 30. As shown in FIG. 1, the barrel 10 can have a breech end 22 at which a chamber 14 is provided. The receiver 20 will include a forward end 12 coupled to the breech end 22 of the barrel 10 and a first side having an ejection port 36. A bolt 50 (FIGS. 9A-9B) generally will be movable in a cycling, forward and back motion along the receiver and will include a bolt body 55 having a bottom surface 51, a first side surface 52A and a second side surface 52B. The bolt 50 can further comprise a stripping lug 60 removably attached thereto, as generally indicated in FIGS. 9A-9B. The magazine well 80 will be received along and mounted externally to the bottom or lower surface of the receiver 20; with the body 81 of the magazine well 80 generally comprising an attachment portion 86 configured for attaching the magazine well 80 to the receiver 20 and a magazine release latch 94.

Figure 5:
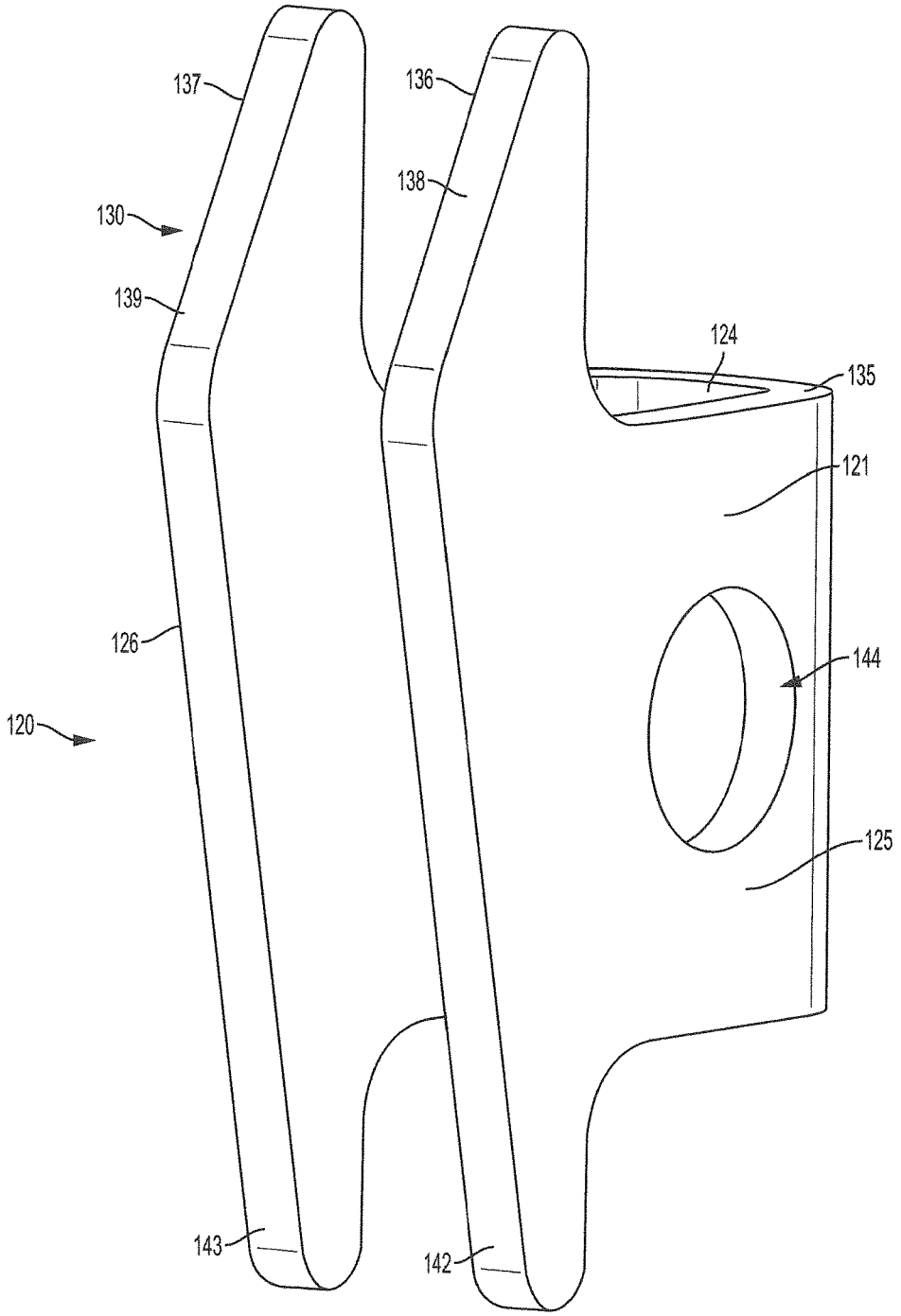
FIG. 5 is a perspective view of the feed ramp of the magazine loading system in accordance with one representative embodiment.

The magazine loading system 5 may further include a feed ramp 120 generally having a body 121 that can be removably mounted at least partially within an existing tubular magazine 33 of the firearm, such as by a fastener 92 that also can be used to mount a forward portion of the magazine well 80 to the firearm. The feed ramp body 121 will have an upper portion 130 that can be angled, sloped or otherwise configured for at least partially engaging and directing shells 100 into the chamber 14 of the shotgun from a magazine 70 (FIG. 5). The magazine 70 further generally can comprise a box, drum or other, similar type of replaceable, externally mountable magazine, and will typically be configured to engage the magazine release assembly 94 when the magazine 70 is inserted into the magazine well 80.

With embodiments of the shotgun or magazine loading system disclosed herein, ammunition, such as cartridges or shells 100, can be loaded from the magazine 70 into the chamber 14 of the firearm, as shown in FIG. 10A, through a feed port 25 defined along a bottom portion of the receiver 20 from the magazine 70 with the cartridge 100 generally directed in an upward direction by the feed lips 77 (FIGS. 7A-7C) of the magazine. As the bolt assembly 50 is brought forward upon further movement of the pump action 35, the striping lug 60 of the bolt 50 can engage and urge the shell 100 into a position 100 into the chamber 14. Additionally, as the shell 100 is brought further toward the chamber 14, the upper portion 130 of feed ramp 120 can guide the front of the shell 100 toward/into the chamber 14 to help prevent the shell 100 from catching or becoming stuck on the barrel 10 and/or breach opening of the barrel 10. Further discussion of the various structures and functions of the shotgun and magazine loading system according to embodiments of the present disclosure are detailed below.

FIG. 1 illustrates a firearm F incorporating a magazine loading system 5 according to one embodiment of the present disclosure. The firearm F can be a shotgun comprising a barrel 10 with a breech end 12 configured to receive and be coupled to the forward end 22 of a receiver 20 (FIG. 1). The barrel 10 of the firearm typically can be made from a hardened steel alloy that has been treated to withstand the elements as well as the forces generated during repeated firings of the firearm, though the barrel 10 may be made of other materials, such as other metals or carbon composites. The firearm further can include a stock 30 coupled to the back end 24 of the receiver 20, and a fire control 40 including a trigger assembly 44. A tubular magazine 33 can be mounted to the forward end 22 of the receiver 20 and can also be connected to a forward portion 11 of the barrel 10, with a fore end or pump action slide 35 movably provided thereon.

As additionally shown in FIG. 1, the receiver 20 may include sides 26 with an ejection port 36 defined in one of the sides for ejecting spent shells/cases 100 after firing. The receiver 20 further will include a port 25 defined in the bottom surface 27 of thereof that receives shells 100 for loading into the chamber 14. The receiver 20 will include an action, including a bolt 50 (FIGS. 8 and 9A-9B) that operates, during the loading portion of the action cycle, to strip/move a shell 100 from the magazine 70 and into the chamber 14 formed within the breech end 12 of the firearm.

Figure 8:
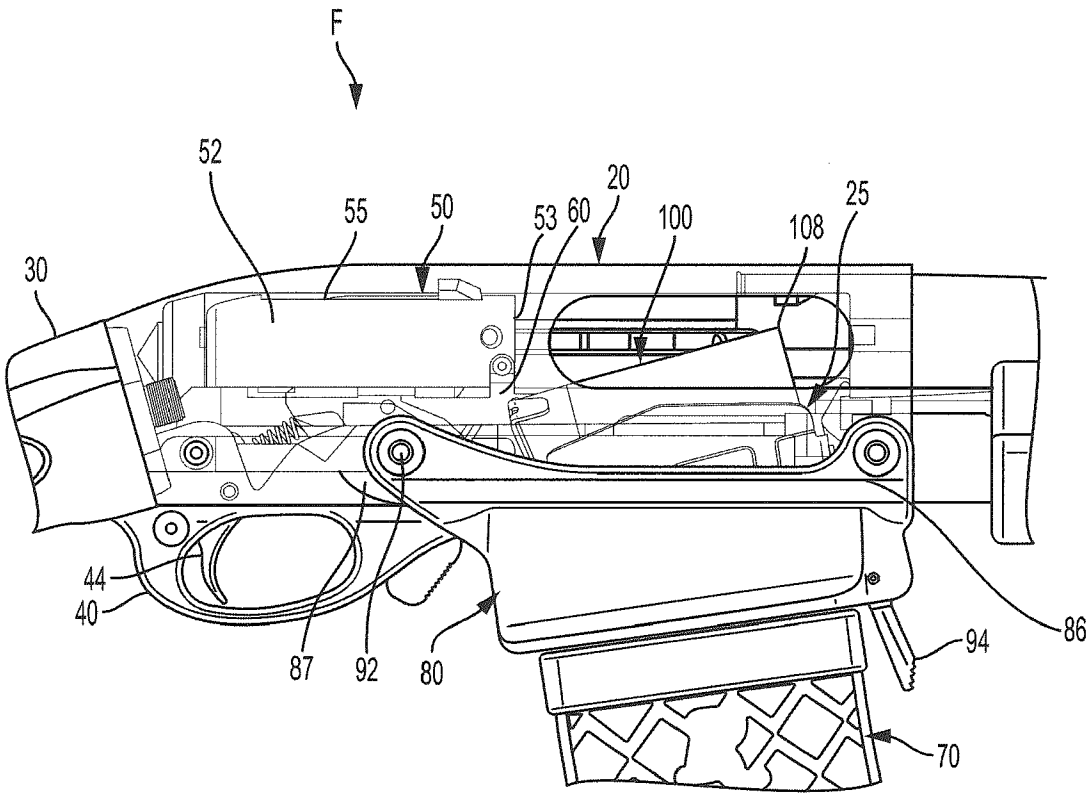
FIG. 8 is a side view of a portion of a shotgun including the magazine loading system of FIG. 1.
Figure 9A:
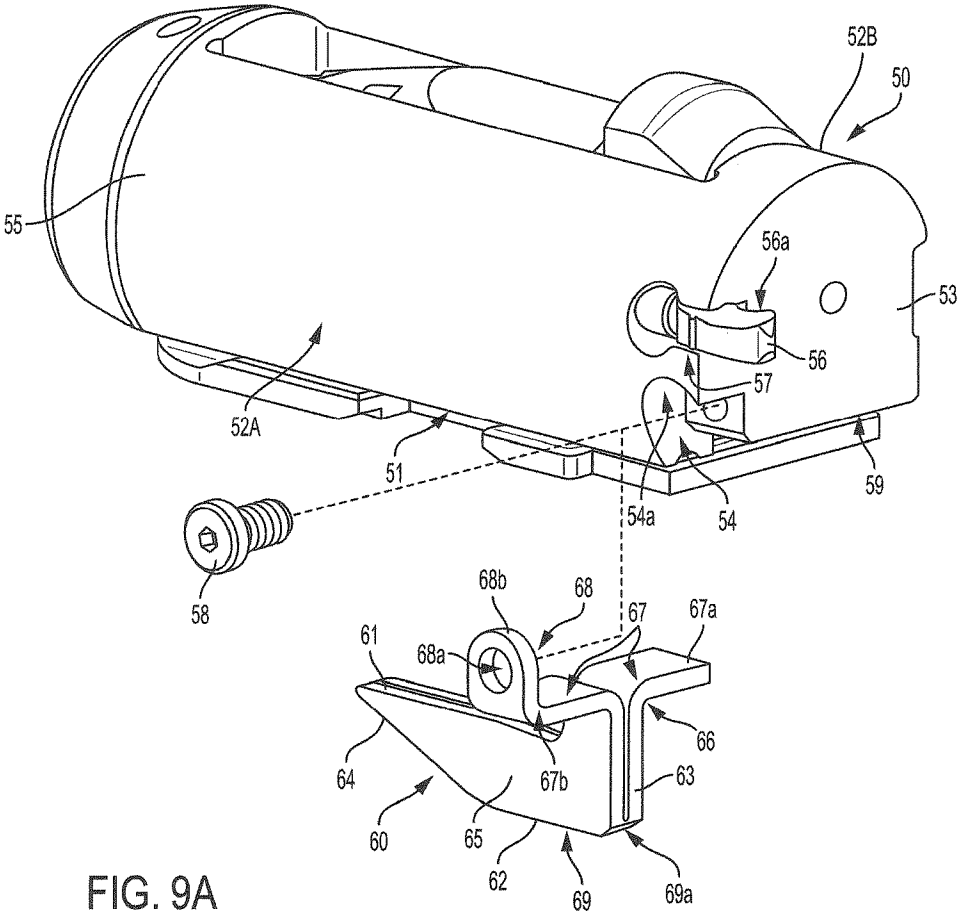
FIG. 9A is an exploded view of the bolt in accordance with an example embodiment.
Figure 9B:
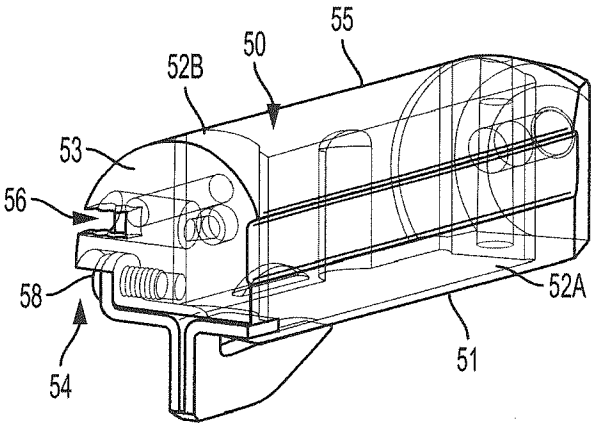
FIG. 9B is a perspective view of a bolt for use in the magazine loading system according to one representative embodiment.

As illustrated in FIGS. 8 and 9A-9B, the bolt 50 generally will include a body 55 having bottom surface 51, a first side surface 52A, and a second side surface 52B, and can have a mating recess or notch 54 defined in the first or second side surface 52A/B adjacent to a front surface 53 of the bolt 50, which notch 54 may define a curved surface 54*a*. A further mating recess or notch 59 also may be defined along the bottom surface 51 of the bolt body. An extractor 56 can be further be pivotally mounted within an extractor mounting channel 57 defined in the first or second side surface 52A/B of the bolt 50, which may be disposed above the notch 54 along the first or second side surface 52A/B. The extractor 56 can include a catch portion 56*a*, which contacts the rim 106 of a shell 100 in the chamber 14 as the bolt 50 moves in a rearward direction, to eject the shell 100 out of the ejection port 36.

FIG. 9A generally shows the bolt 50 with a stripping lug 60 removably attached thereto. The stripping lug 60 may generally include a body with a top portion 61, a bottom portion 62, a front portion 63, a rear portion 64, and side portions 65. The top portion 61 may have a protruding portion 66 adjacent the front portion 63 of the stripping lug 60, which protruding portion 66 further may include one or more attachment flanges 67 attached thereto and extending outwardly therefrom. The attachment flanges 67 each can have a substantially flat upper surface 67*a* generally configured for mating with or being in face to face registration with the bottom surface 51 of the bolt 50 and can further be attached to an attachment portion 68, which can be configured and/or sized to fit within the mating recess or notch 54, protruding upwardly from and arranged on a side portion 67*b* of at least one of the attachment flanges 67. The attachment portion 68 also may include an aperture or bore 68*a* defined therethrough and can include a substantially curved upper surface 68*b* configured for generally mating or engaging in registration with the curved surface 59*a* defined by recess 54. The stripping lug 60 can further include a guide portion 69 disposed on a flat surface of the bottom portion 62, and a recessed surface or guide notch 69*a* configured to engage with the rim 106 of a shell 100 can be defined in a front end of the guide portion 69. During operation of the firearm, the side of the pump is cycled forward, it moves the bolt 50 forward, such that the stripping lug 60 can engage a shell 100 from the magazine and urge it toward and into the chamber 14 of the firearm.

Additionally, the an attachment portion 68 of the lug 60 may be aligned and received in the notch 54 of the bolt body 55 with the notch 54 being generally sized and shaped to accommodate the outer dimensions of the attachment portion 68. Further, the attachment flanges 67 may be aligned and received in the notch 59 so that the flat upper surfaces 67*a* of the attachment flanges 67 are brought into face-to-face contact with the bottom surface 51 of the bolt. Then a screw 58 may be inserted through the aperture 69*a* to securely attach the lug 60 to the bolt 50. This screw 58 can further be positioned such that it is out of line with the recoil forces, which screw 58 may further be externally accessible, such as through the ejection port 36, so that the stripping lug 60 can be easily attached to/removed from the bolt without the need for complete disassembly of the firearm.

The stripping lug 60 also may be used in an embodiment of a magazine loading system in which a shotgun having a tubular magazine is to be converted into a shotgun configured to receive a box, drum or other external type of removable magazine. In this embodiment, the stripping lug 60 can be attachable to and/or removable from the existing bolt of the shotgun having a tubular magazine, in a similar manner as discussed above.

As shown in FIGS. 1-4, the magazine well 80 can be received/fitted along and mounted externally to the receiver 20. The magazine well 80 can be made from a metallic or similar material such as aluminum alloys or other lightweight materials, so as to reduce the overall weight of the firearm, though the magazine well can be made from other materials, such as other metals or carbon composites. The magazine well 80 may generally include a body 81 with side portions 82, front or forward portion 83, and rear or back portion 84 that define an inner space or cavity 85 configured to receive a magazine 70 (e.g., a box style magazine). The magazine well 80 may further include an attachment portion 86 disposed on top of the body 81 that is sized, dimensioned, and configured to receive at least a portion of the receiver 20 and secure the magazine well 80 thereto. The attachment portion 86 may be configured as an enlarged sleeve or saddle having a first portion 88 and a second portion 89, and generally will be shaped (e.g., generally U-shaped) to substantially correspond to and mate with the bottom 87 of the receiver 20. The first and second portions 88/89 may include front and rear protruding portions 90/91, which may include apertures or holes 102/103 defined therein.

Figure 2:
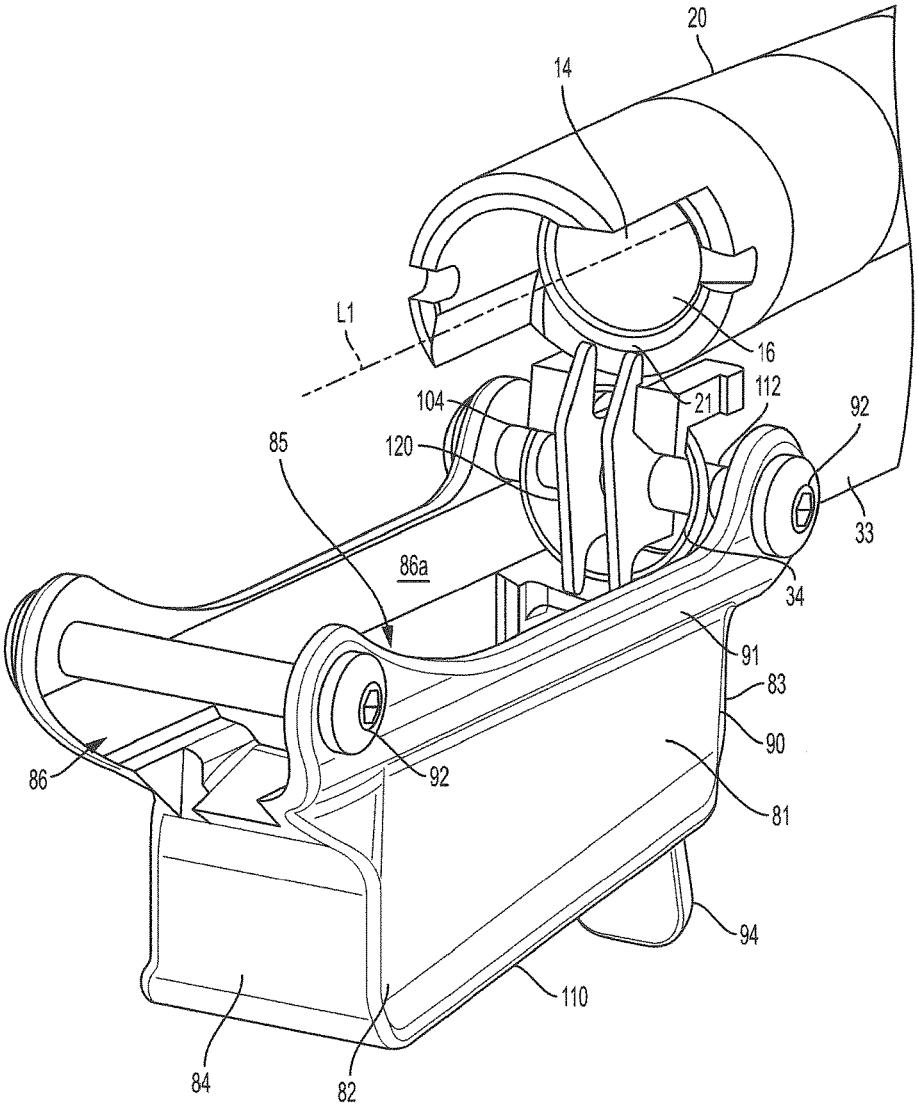
FIGS. 2-3 are perspective, cut-away views of the partially assembled magazine loading system, in accordance with one representative embodiment.
Figure 3:
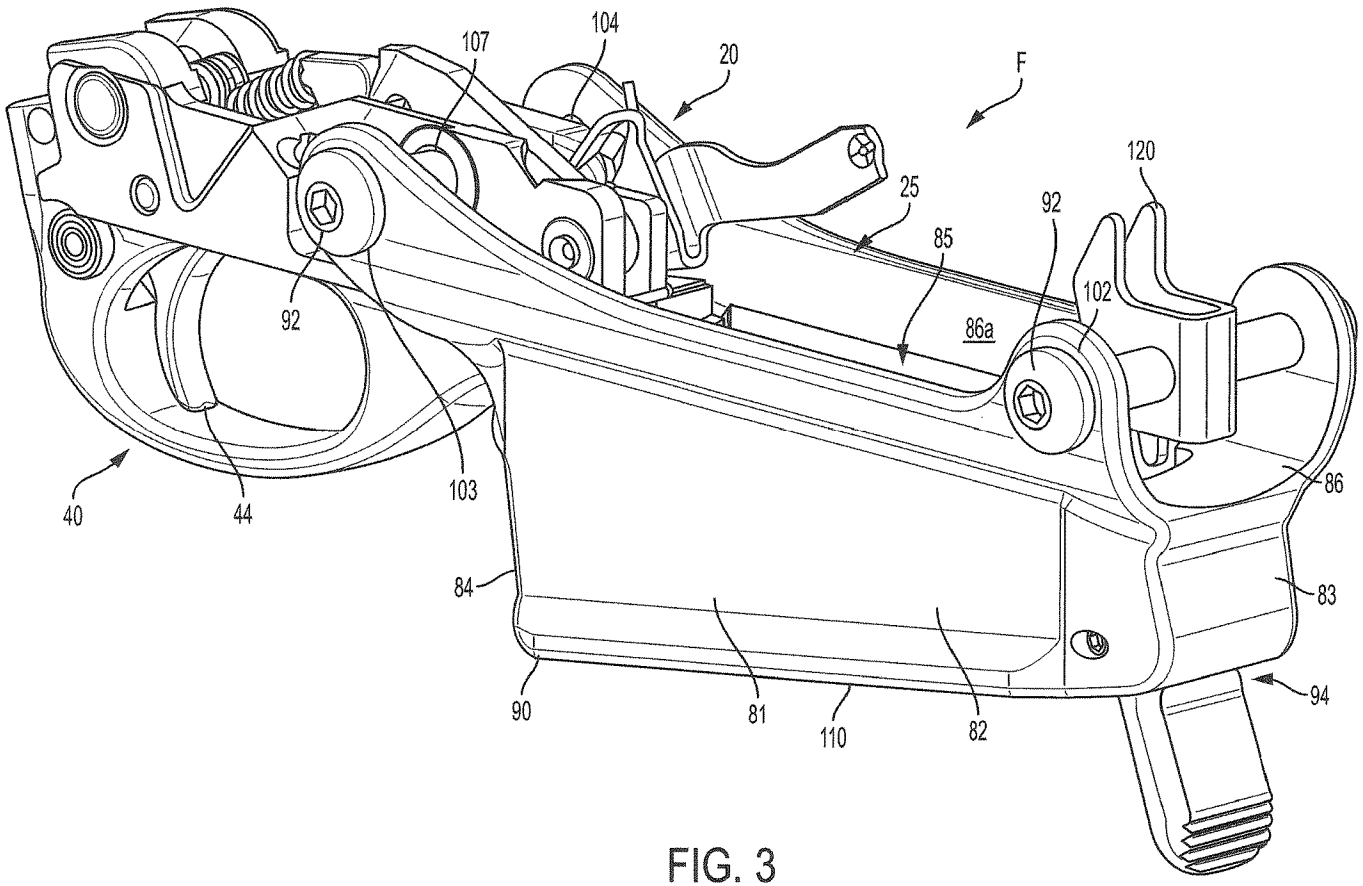

In one embodiment, the magazine well 80 will be attached to the exterior, or outer surface, of the receiver 20 using mechanical attachment means including fasteners such as, for example, screws, pins and any other attachment means that allow for the magazine well 80 to be removable from the firearm. For example, the magazine well 80 can be attached to the receiver using fasteners, such as bolts or screws 92 (FIG. 1). As illustrated in FIGS. 1-3, an inner surface portion 86*a* (FIG. 2) of the attachment portion 86 can be generally arranged on or mated with the bottom surface 27 (FIGS. 1 and 8) of the receiver 20 so that cavity 85 (FIG. 3) of the magazine well is substantially aligned with and open to the injection port 25 of the receiver 20. Further, the holes 102/103 (FIG. 4) of the front and rear protruding portions 90/91 can be aligned with apertures or holes 104 defined in the side walls 26 of the receiver. As indicated in FIG. 3, the apertures or holes 103 may correspond to the front trigger pin hole 107 formed in the receiver and trigger assembly 44 for mounting the fire control 40/trigger assembly 44 to the receiver using the same fastener. Holes 102 can align with holes 104 formed through the tubular magazine 33, as indicated in FIG. 1. Fasteners 92 can then be inserted into the through holes 102/103 and holes 104 to secure the magazine well 80 to the receiver 20.

The magazine well 80 may be used in the embodiment of a magazine loading system in which a shotgun having a tubular magazine is converted into a shotgun configured to receive a box, drum or other external type of removable magazine. For example, the magazine well 80 may be attachable to/removable from the receiver of the shotgun having a tubular magazine. In this embodiment, the holes 103 can correspond with the existing front trigger pin holes in the receiver and trigger of the tubular shot gun being converted, such that the same fastener used for mounting the trigger assembly to the receiver can also be used to mount the rear of the magazine well to the receiver. Additionally, a second set of holes 104 can be drilled or machined through the receiver and/or magazine tube of the firearm. Screws 92 can be inserted into the through holes 103 and the existing trigger assembly holes and into holes 102 and the corresponding holes 104 drilled through the receiver and/or tubular magazine well of the shotgun to attach the magazine well 80 to the shotgun.

Figure 6:
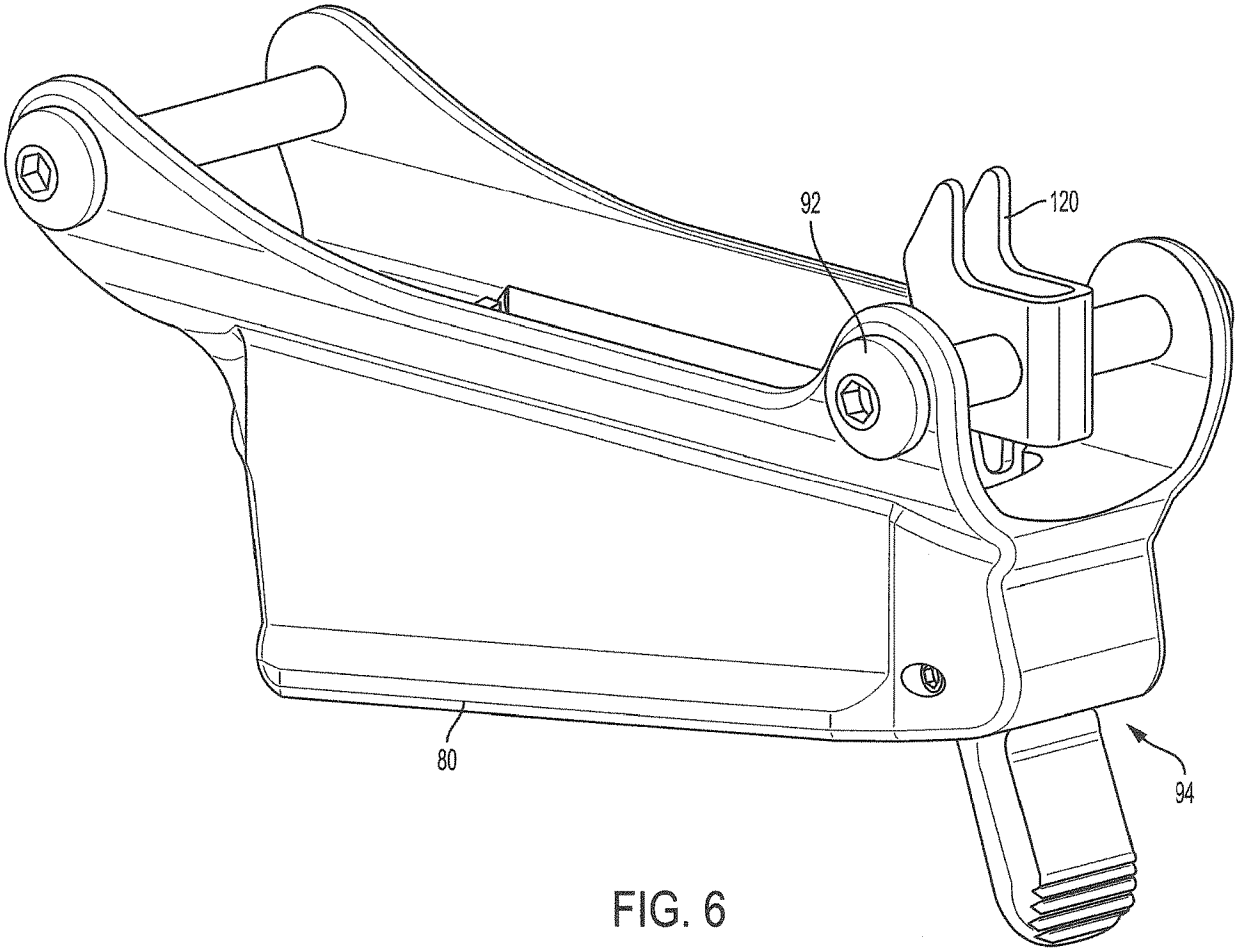
FIG. 6 is a perspective view of the magazine well and the feed ramp of the embodiment illustrated in FIG. 5.

As generally shown in FIGS. 5-6, the feed ramp 120 of the magazine loading system may generally comprise a body 121 formed from a high strength material, such as a metal. The body 121 can have a generally U-shaped configuration, including a middle or center portion 124 and side portions 125/126, through which holes or apertures 144 can be defined therein for attachment to the magazine tube 33 of the firearm using the attachment screw 92. In this regard, the feed ramp 120 can be positioned at, adjacent to, or substantially near a forward portion of the magazine well 80 and within an opening 34 of the tubular portion 33, such that the feed ramp 120 is disposed between the bottom of the chamber 14 of the barrel 10 and the inner surface 86*a* of the attachment portion 86 as generally illustrated in FIG. 2.

Additionally, the feed ramp 120 can have an upper portion 130 (FIG. 5) including sloping protrusions 136/137 extending upwardly from substantially flat upper surfaces 135 of the side portions 125/126. The protrusions 136/137 define guide surfaces 138/139 that can be formed at a first angle or slope relative to the longitudinal axis L1 (FIG. 2) of the barrel 10. The guide surfaces 138/139 also will be configured to engage or guide a shell 100 fed into the chamber 14 to prevent the shell 100 from catching. During operation of the firearm, as the striping lug 60 of the bolt 50 moves the cartridge 100 toward the chamber 14, the engagement of the shell with the guide surfaces 138/139 of the feed ramp 120 can guide the nose 108 of the shell 100 toward/into the chamber 14. The side portions 125/126 of the feed ramp 120 also can have bottom protrusions 142/143 that can extend to/along the inner surface 86*a* of the body of the attachment portion 86. Although the present embodiment includes a feed ramp with a generally U-shape body with side portions, the body of the feed ramp could be otherwise shaped, arranged or configured without departing from this disclosure. For example, the body of the feed ramp could be substantially solid and may comprise only one ramp portion which extends the entire width of the feed ramp without departing form the spirit of the disclosure.

The feed ramp 120 also can generally be made from a different material than a material of the receiver 20, such as a higher strength metal or metal alloy materials, which will have a substantially higher impact toughness and/or strength than the material of the receiver 20. For example, the receiver 20 can be made from a first metallic material (e.g. aluminum) while the feed ramp 120 can be formed from a second metallic material that is different from, e.g., harder and/or having a greater impact toughness than, the first metallic material of the receiver 20. In one embodiment, the feed ramp 120 can be formed from a similar hardened steel alloy material as the barrel 10. Indeed, in other aspects it may also be desirable for the feed ramp 120 to be made from an alloy material that is harder and more impact resistant than the hardened steel alloy forming the barrel 10. The use of such materials having higher or increased impact toughness can provide for smoother feeding of ammunition, while at the same time, reducing wear, peening and/or galling of its surfaces, thus potentially increasing the operating cycles of the firearm while reducing maintenance and polishing required for the feed ramp 120.

In one embodiment of the magazine loading system 5 in which a shotgun F having a tubular magazine is converted into a shotgun configured to receive a box, drum or other external type of removable magazine, the feed ramp 120 can be at least partially mountable within the existing magazine tube of the shotgun F. For example, in such embodiment, before screw 92 is inserted into the through holes of the tubular magazine 33 and the magazine well 80, as discussed above, the feed ramp 120 can be arranged in the open end of the shotgun magazine tube 33 with its apertures 144 aligned with the through holes 102 so that the screw 92 may be inserted into the aperture 144 for connecting the feed ramp 120 to a front portion of the magazine well 80 and the existing magazine tube. The removable nature of the feed ramp 120 allows the guide surface 138/139 of the feed ramp to protrude up to the bottom edge of the chamber creating a substantially continuous ramp for the cartridge without leaving an area for the cartridge to get caught. The removable feed ramp 120 also generally prevents the surfaces 138/139 from blocking or otherwise preventing the bolt assembly from being inserted into/removed from the receiver 20 for assembly or cleaning.

Figure 7A:
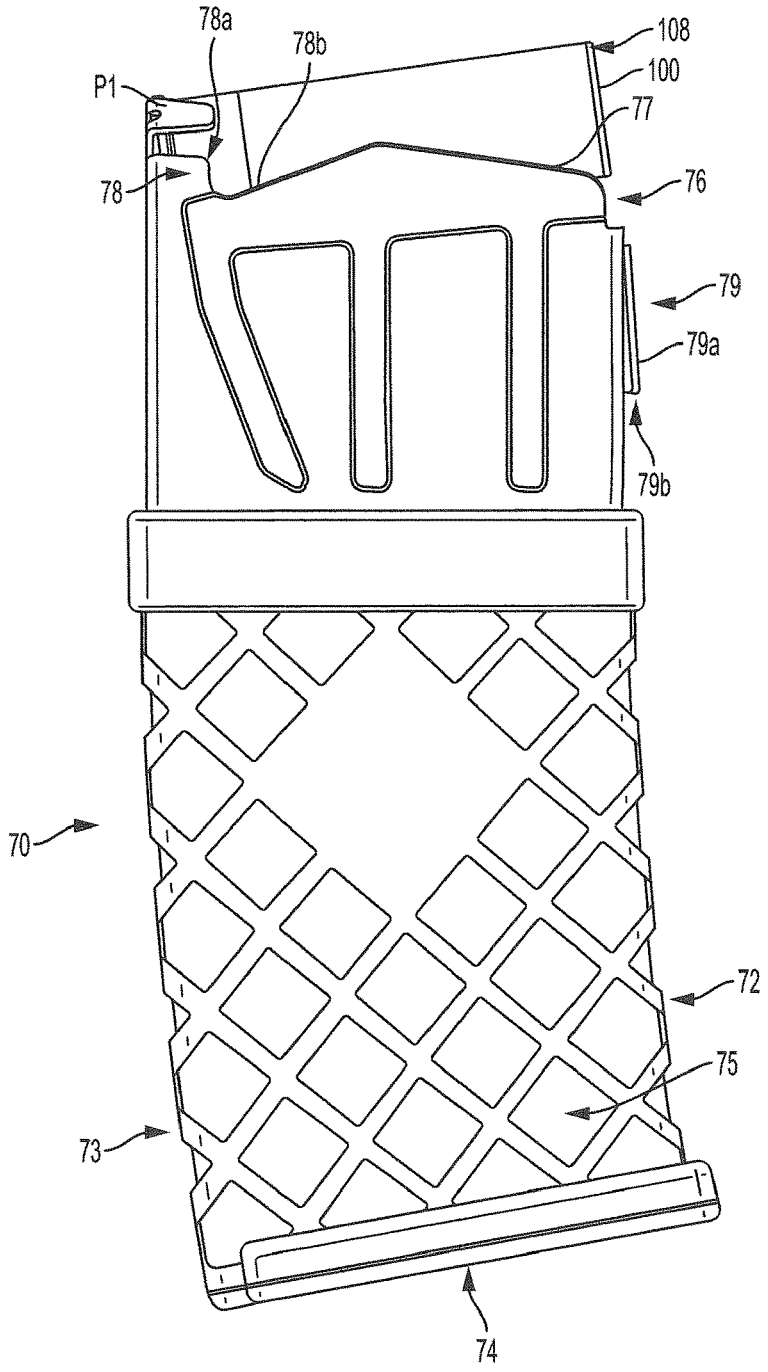
FIGS. 7A-7C are views of a magazine for use with the magazine loading system in accordance with one representative embodiment.
Figure 7B:
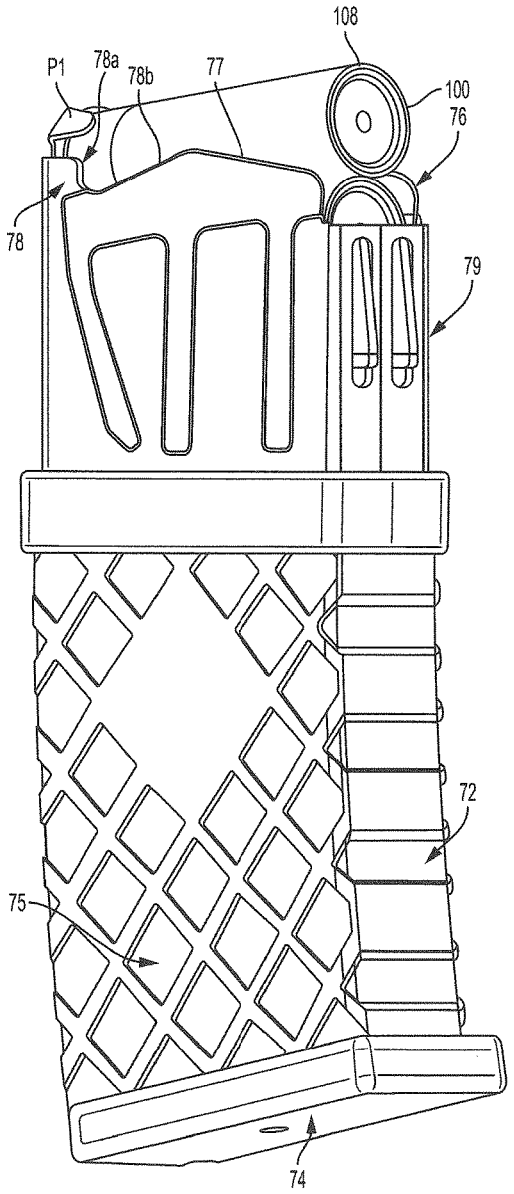
Figure 7C:
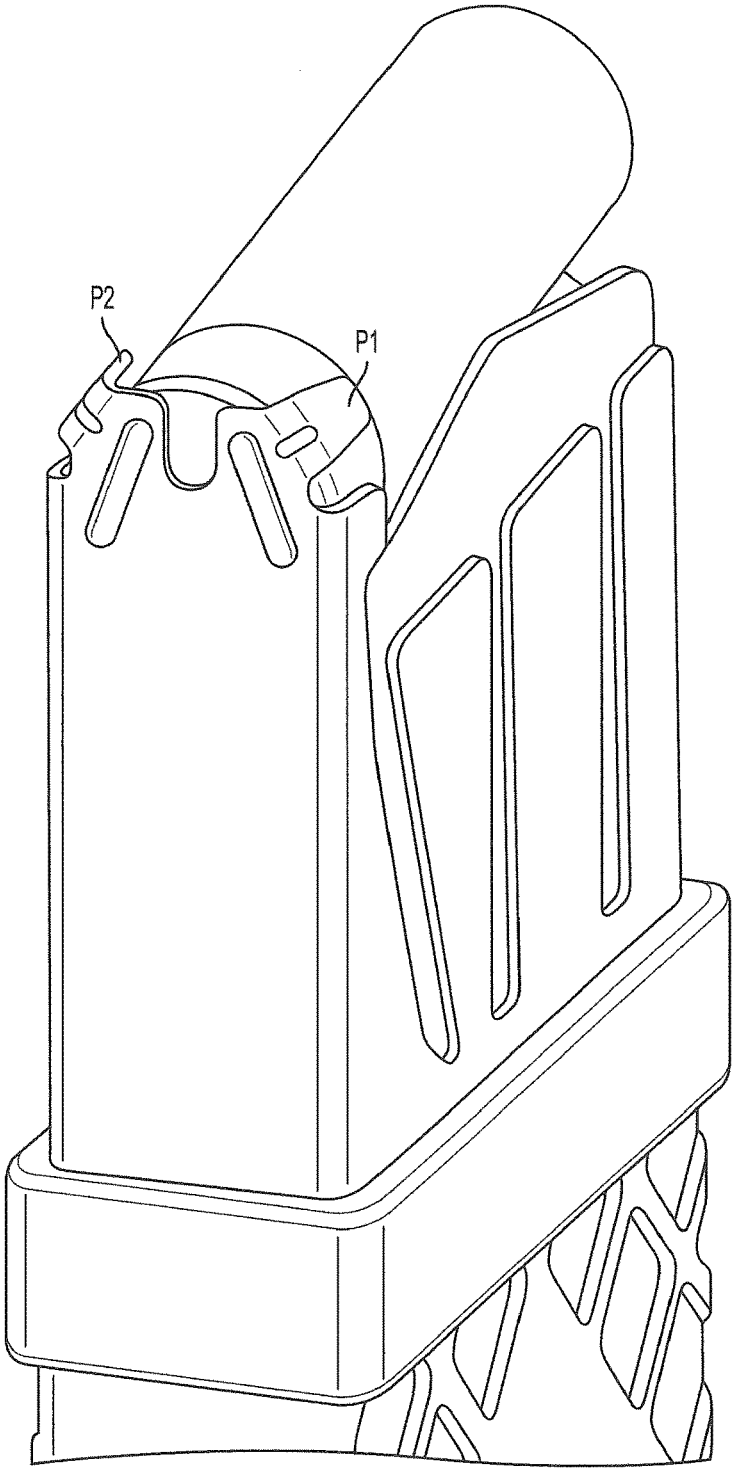
Figure 10:
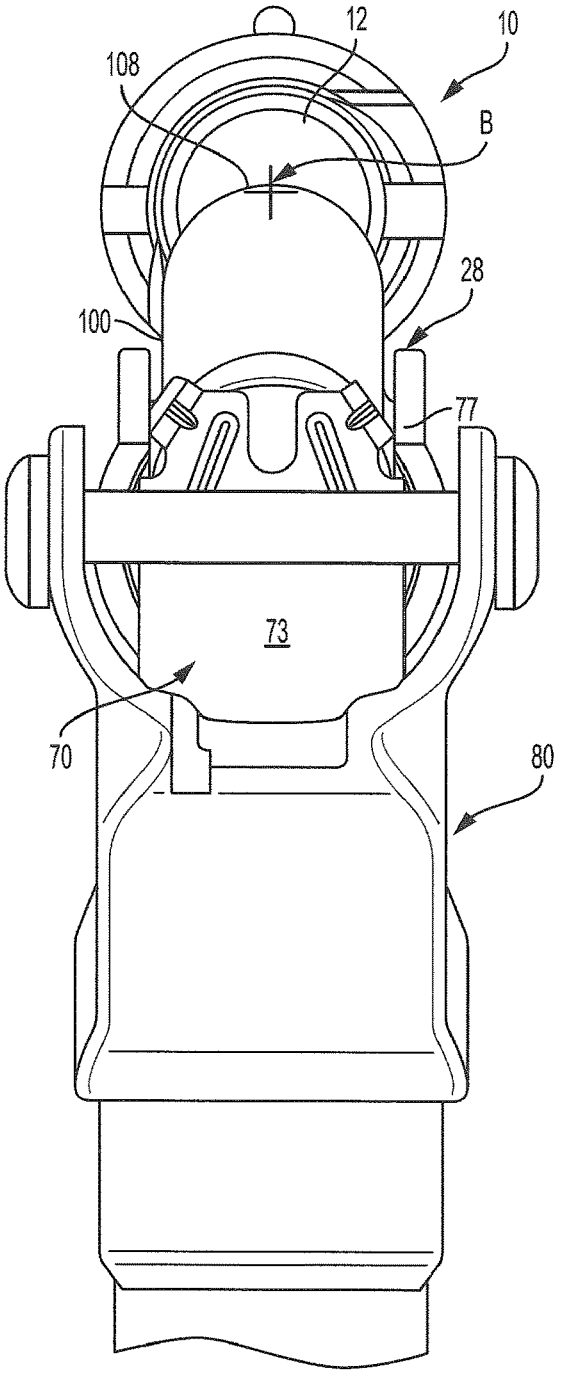
FIG. 10 is an end view of the magazine loading system of FIG. 1 showing a shell being loaded from the magazine of FIGS. 7A-7D into the chamber of the firearm.

FIGS. 7A-7C are views of a magazine 70 for use with the magazine loading system in accordance with one representative embodiment of this disclosure. As shown in FIGS. 7A-7C, the magazine 70 can be received with the magazine well 80 for containing a supply of ammunition (e.g., shells 100) for feeding to the chamber 14 of the barrel 10. The magazine 70 may generally include a body 71 with a front wall 72, a rear wall 73, a bottom wall 74, and side walls 75 with feed lips 77, generally defining a cavity or chamber 76 for containing a supply of shells 100. The rear wall 73 can include protrusions P1 and P2 (FIG. 7C) defined adjacent an upper end thereof, which protrusions P1 and P2 are configured for engaging shells 100. The configuration of the protrusions P1/P2 further can enable receipt of the shells fed from the magazine 70 at a higher elevation within the receiver, such as indicated in FIG. 8. As a result, the cartridges or shells can be directed toward and/or located closer to a center-line axis B of the bore of the barrel 10 to help ensure consistent and/or reliable feeding of shells into the chamber 14. The configuration of the protrusions P1, P2 further can help reduce or substantially avoid interference between the magazine feed lips 77 and action bars 28 of the firearm, as indicated in FIG. 10.

The magazine 70 also generally includes a cartridge platform provided within the cavity that is biased upward by a spring or other suitable biasing mechanisms/members. As further illustrated in FIG. 7B, the side walls 75 of the magazine 70 can have a guide portion or feed ramp 78 disposed therealong for directing, angling or otherwise positing a shell or round of ammunition fed from the magazine. This feed ramp 78 may include projecting portions 78*a* extending or projecting inwardly from the sidewalls 75, and the guide portion feed ramp 78 of the magazine may further include a notch 78*b* defined in a top portion of one or more of the side walls 75, which notch 78*b* can extend to feed lips 77 and further generally will define a guide surface on one or both sides of the magazine. As such, during operation of the firearm, as the cartridge 100 is fed towards the chamber 14 by the bolt 50, the projections angle the body of the shell 100 in an upward direction such that the nose 108 of the shell is directed toward the chamber 14.

Figure 4:
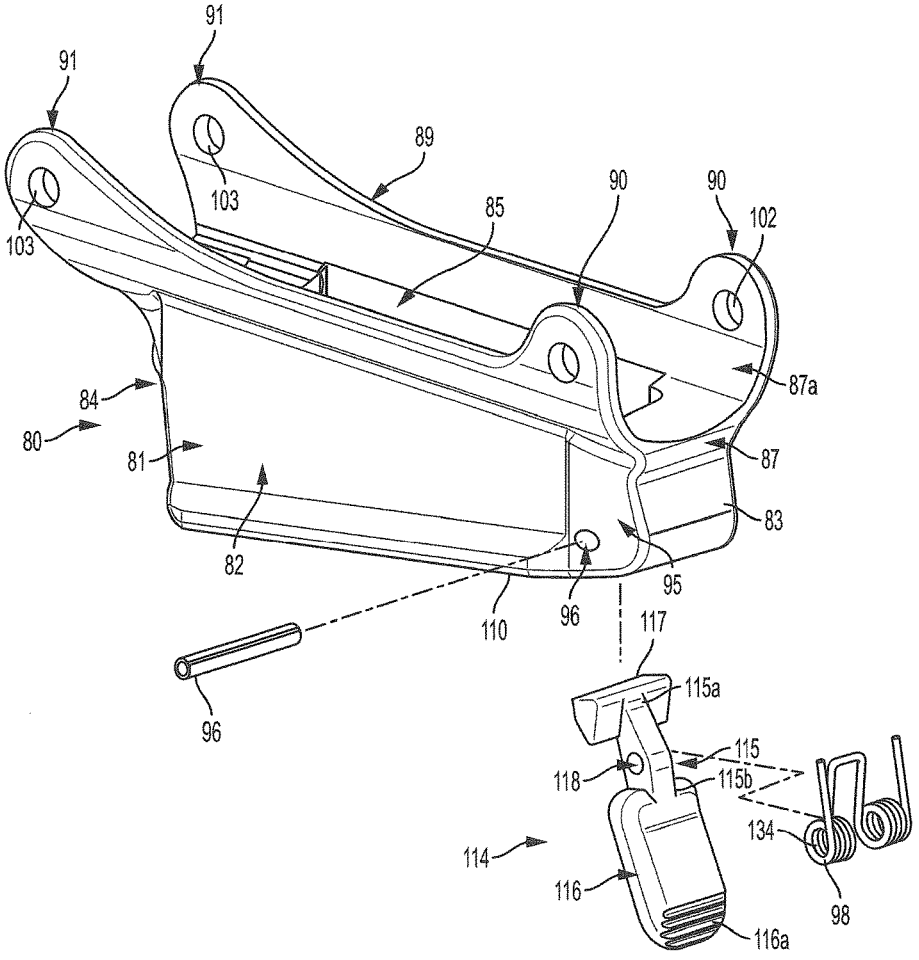
FIG. 4 is an exploded perspective view of the magazine well of the magazine loading system in accordance with one representative embodiment.

Further, the magazine 70 will comprise an attachment portion that includes a ramped section 79*a* and a lip or catch 79*b* disposed on the front wall 72 of the magazine 70 and configured to engage a magazine release assembly 94 of the magazine well 80 to releasably/detachably connect the magazine 70 to the magazine well 80. As shown in FIG. 4, the magazine release assembly 94 can include a locking/releasing portion 114 with a body 115 that can include a lever or switch portion 116 disposed at a first end 115*a* of the body 115 and a catch portion or surface 117 disposed at a second end 115*b* of the body 115. The body 115 may also have a hole or aperture 118 defined therein so that the locking/releasing portion 114 can be attached to the sidewalls 95. Generally, the locking/releasing portion 114 can be disposed between the side walls 95 and a pin or rod 97 can be inserted through an aperture 96 to pivotally mount the locking/releasing portion 114 within sidewalls 95. The magazine release assembly 94 may also comprise a spring, which applies a biasing force to the locking releasing portion 114. This spring 98 may include openings 134 that can be aligned with the aperture 117 of the locking/releasing portion 114 so that the pin 97 can be received therethrough to attach the spring to the body 115 of the locking/releasing portion 114, and the spring 98 may be configured to bias or force the catch portion 117 of the locking/releasing assembly against a surface of the front portion 83 of the magazine well 80.

With this arrangement, according to embodiments of the present application, the magazine 70 can be inserted into the inner space or cavity 85 of the magazine well 80 configured to receive a magazine 70 such that the ramp section 79*a* engages catch portion 117 so as to force the catch portion 117 away from the front portion 83 of the magazine well. To release the magazine 70 from the magazine well 80, a user can press the lever 116, to disengage the catch portion 117 from the corresponding catch 79*b* of the magazine to allow the magazine 70 to move or slide out of the magazine well 80. Though embodiments of the present disclosure provide attachment of the magazine 70 and magazine well 80 using the above described attachment assembly, the embodiments of the present disclosure are not limited thereto and may include other suitable attachment assemblies and/or systems for releasably attaching the magazine 70 to the magazine well 80.

Figure 11A:
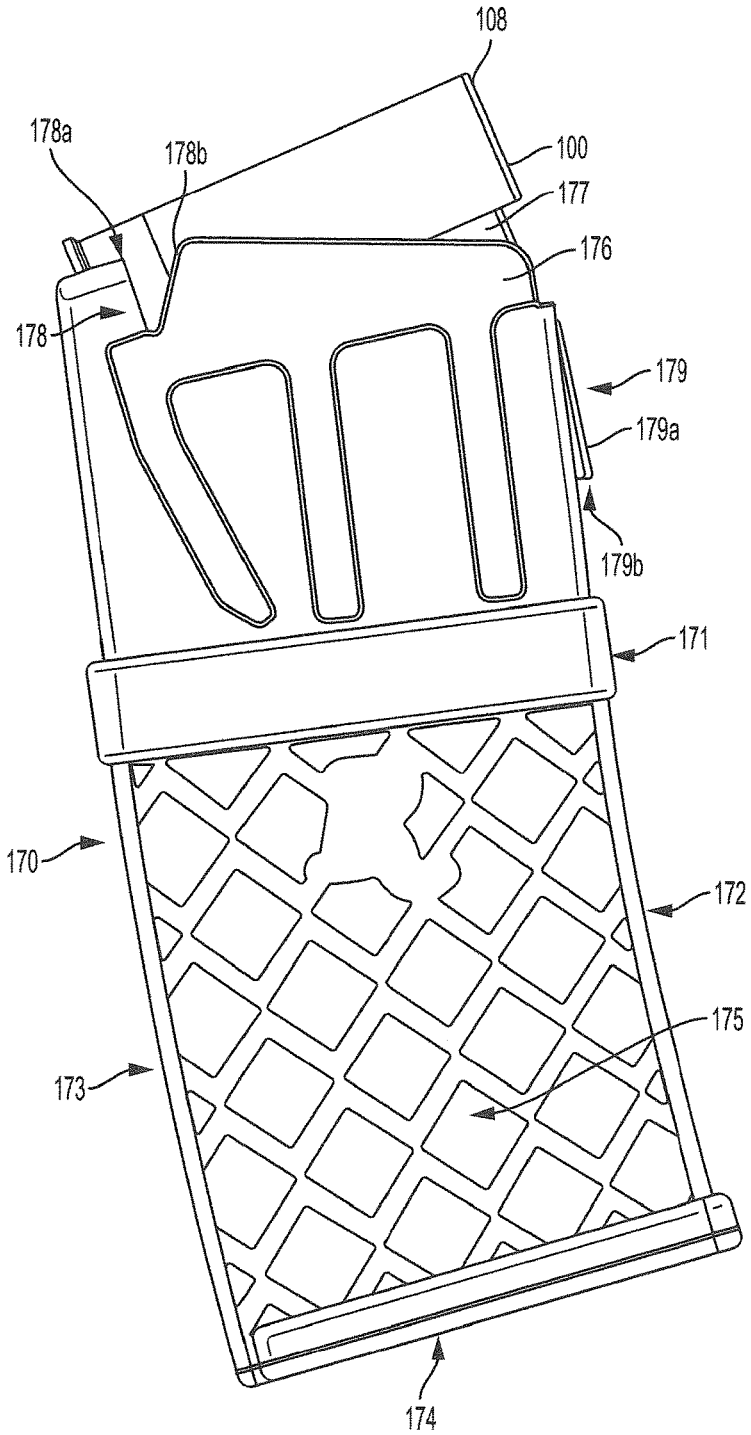
FIGS. 11A-11B are side views of a magazine for use with the magazine loading system in accordance with a second representative embodiment.
Figure 11B:
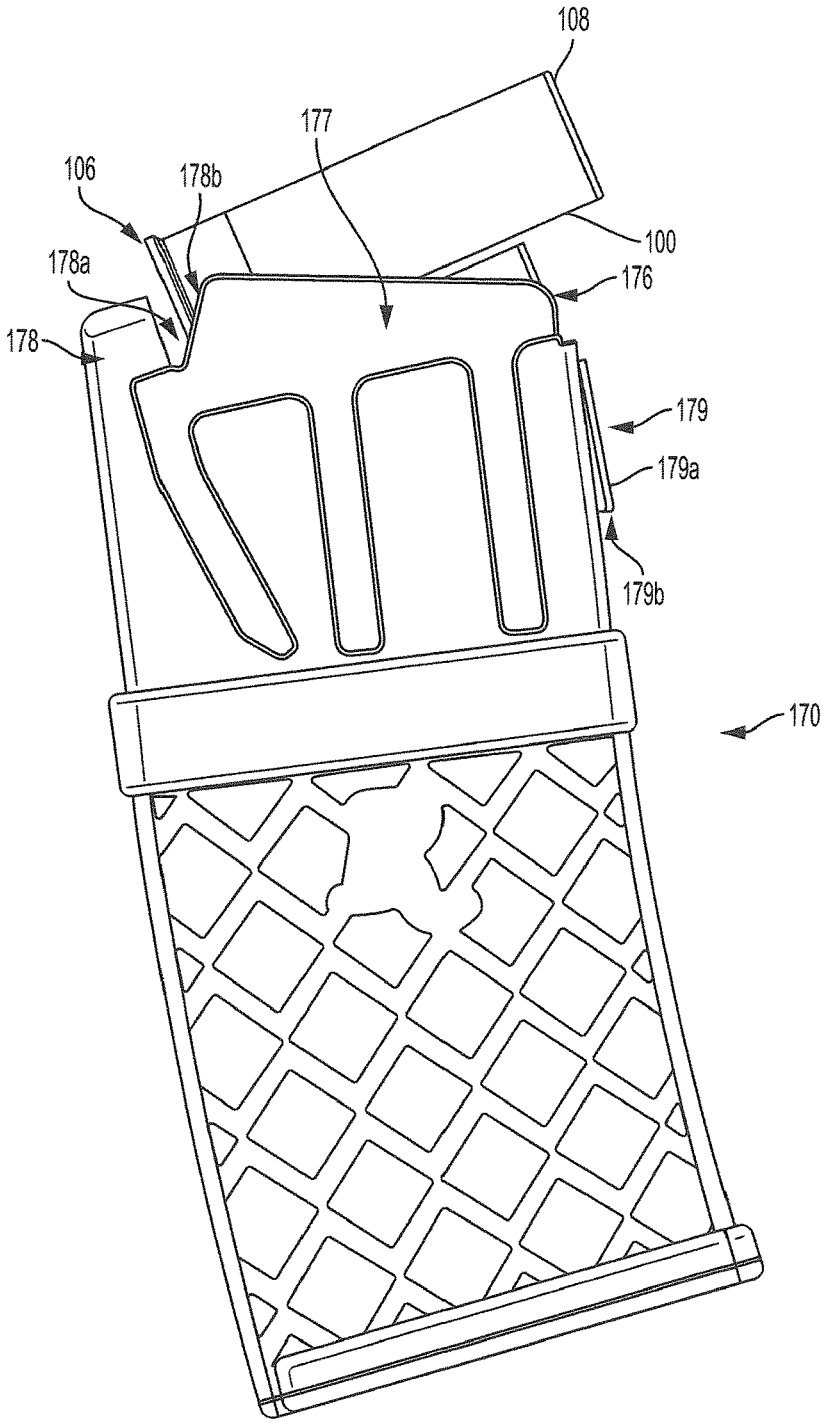
Figure 12:
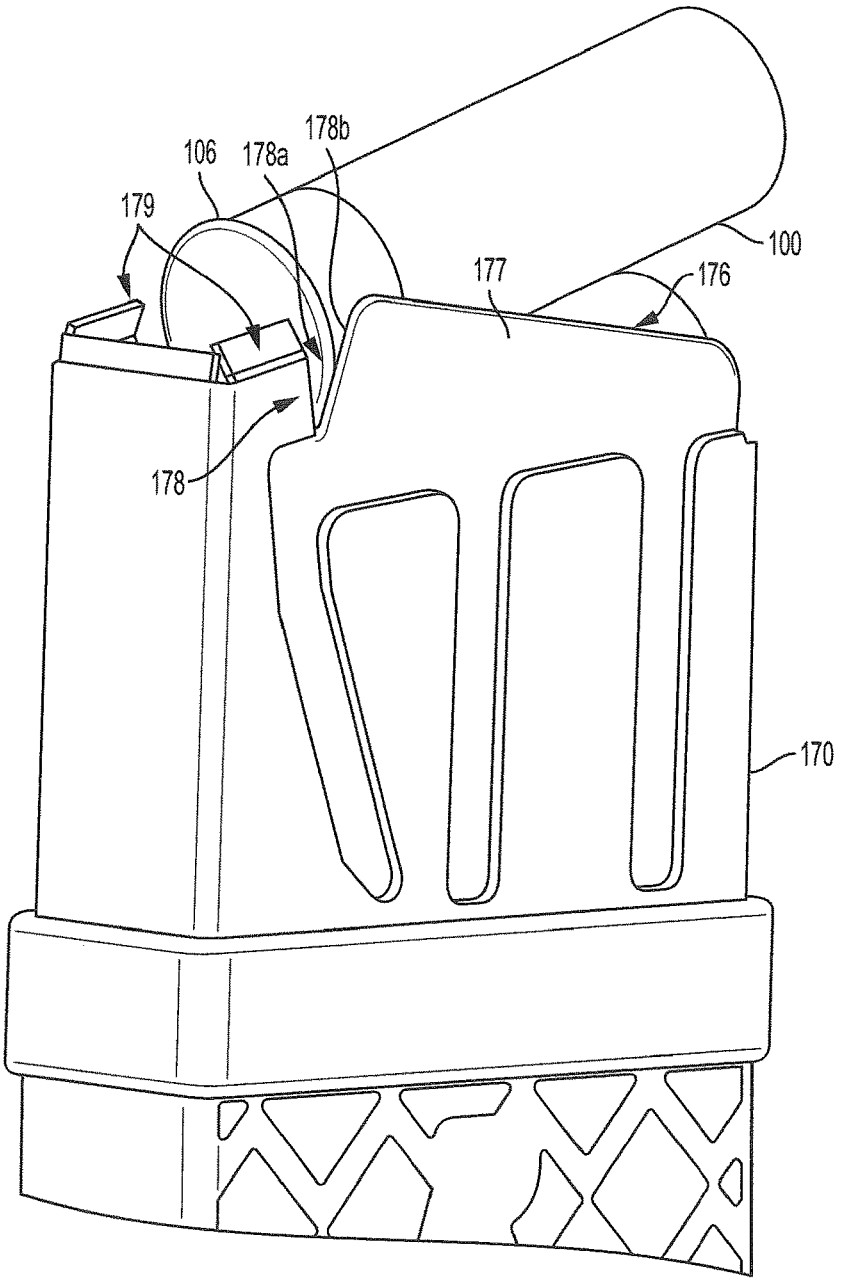
FIG. 12 is a perspective view of the magazine of the second example embodiment shown in FIGS. 11A-11B.

FIGS. 11A-11B and 12 illustrate another embodiment of a magazine 170 that can be received with the magazine well 80 for containing a supply of ammunition (e.g., shells 100) for feeding to the chamber 14 of the barrel 10. The magazine 170 may generally include a body 171 with a front wall 172, a rear wall 173, a bottom wall 174, and side walls 175 with feed lips 177, which body 171 generally defining a cavity or chamber 176 for containing a supply of shells or rounds of ammunition 100. The magazine 170 generally includes a cartridge platform provided within the cavity that is biased upward by a spring or other mechanism. As further illustrated in FIG. 11A-11B, the side walls 175 of the magazine 170 can have feed ramp offset 178 disposed therealong. This feed ramp offset 178 may include projecting portions 178*a* extending or projecting inwardly from the sidewalls 175, and the feed ramp offset 178 may further include a notch 178*b* defined in a top portion of one or more of the side walls 175, which may include an angled ramp portion 178*b*. The ramp portion 178*b* may extend or project inwardly towards the interior of the cavity 176 of magazine body 171, such that the ramp portion 178*b* is offset or set in with respect to the sidewalls 175, allowing the ramp portion 178*b* to catch or engage the rim of the shells, rounds or cartridges 100. As such, during operation of the firearm, as a cartridge 100 is fed towards the chamber 14 by the bolt 50, the projections 178*a* angle the body of the cartridge 100 in an upward direction such that the nose 108 of the cartridge is directed toward the chamber 14. As the round 100 is fed further toward the chamber 14, the ramp 178*b* of the feed ramp offset portion 178 can catch or engage the rim 106 of the round 100, and with the feed lips 177, guide the shell 100 towards the chamber 14 at a continued upward angle with the nose 108 being directed/positioned in a direction toward the chamber 14.

This exemplary magazine also may be used in conjunction with the magazine well in the embodiment of a magazine loading system in which a shotgun having a tubular magazine is converted into a shotgun configured to receive a box, drum or other external type of removable magazine.

The invention has been described in terms of preferred embodiments and methodologies considered by the inventors to represent the best mode of carrying out the invention. A wide variety of additions, deletions, and modification might well be made to the illustrated embodiments by skilled artisans without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed is:

1. A shotgun, comprising:

a barrel including a breech end at which a chamber is provided;

a magazine tube mounted beneath the barrel;

a receiver having a forward end coupled to the breech end of the barrel, and a port defined in a bottom surface of the receiver through which rounds of ammunition are received for feeding into the chamber;

a bolt movable along the receiver and configured to direct the rounds of ammunition towards the chamber;

a magazine well releasably mounted along the bottom surface of the receiver, the magazine well including a body having forward, rear and side portions, with a cavity defined therethrough;

a removable magazine configured to be at least partially received with the magazine well, the removable magazine containing a supply of ammunition and comprising a guide portion configured to direct the rounds of ammunition upwardly through the port of the receiver;

a feed ramp removably mounted within the magazine tube at a position forward of the magazine well and adjacent the chamber, the feed ramp configured to guide the rounds of ammunition from the magazine and toward the chamber, and comprising a body that is at least partially received within the magazine tube; and a fastener passing through the magazine tube and the body of the feed ramp to locate and removably mount the feed ramp in the magazine tube.

2. The shotgun of claim 1, the removable magazine further comprising a body with a series of protrusions extending from an upper end of the body, wherein the protrusions are configured to engage the rounds of ammunition so as to substantially locate the rounds of ammunition adjacent to a center-line axis of the barrel to facilitate consistent feeding of the rounds of ammunition into chamber.

3. The shotgun of claim 1, wherein the bolt further comprises a stripping lug configured to engage a rear end of the rounds of ammunition and urge each round of ammunition along the guide portion of the removable magazine and out of the magazine as the bolt is cycled through the receiver.

4. The shotgun of claim 3, wherein the guide portion of the magazine further comprises a notch defined in a top portion in one or more side walls of the magazine, the notch configured to guide the rounds of ammunition towards the chamber as they are engaged by the stripping lug.

5. The shotgun of claim 1, wherein the body of the feed ramp comprises a center portion; at least one side portion projecting forwardly therefrom; and an upper portion configured for directing the rounds of ammunition into the chamber.

6. The shotgun of claim 5, wherein the upper portion of the body of the feed ramp includes a pair of sloped protrusions defining angled guide surfaces for guiding the rounds of ammunition towards the chamber of the firearm.

7. The shotgun of claim 1, further comprising:

a feed ramp offset defined along the removable magazine, the feed ramp offset being configured to contact a rim of the rounds of ammunition so as to guide a nose portion of each of the rounds of ammunition upwardly in a direction substantially towards the chamber.

8. The shotgun of claim 1, wherein the removable magazine comprises a box or drum magazine.

9. The shotgun of claim 1, wherein the guide portion of the removable magazine includes one or more protruding portions projecting inwardly from a side wall of the magazine so as to engage a rim of the rounds of ammunition and direct a nose of each round of ammunition towards the chamber.

10. The shotgun of claim 1, wherein the magazine well further comprises attachment portion having a saddle configuration in which the bottom surface of the receiver is sealed, and with mounting apertures defined in front and rear portions thereof; wherein at least one of the mounting apertures aligns with an existing mounting hole of the receiver to enable mounting of the magazine well to the receiver using the existing mounting hole and a fastener thereof.

11. The shotgun of claim 1, further comprising:

a magazine release assembly including a locking portion configured to fix the removable magazine within the magazine well.

12. A shotgun, comprising:

a barrel including a breech end at which a chamber is provided;

a magazine tube mounted beneath the barrel;

a receiver having a forward end coupled to the breech end of the barrel, and a port defined in a bottom surface of the receiver through which rounds of ammunition are received for feeding into the chamber;

a bolt movable along the receiver and configured to direct the rounds of ammunition towards the chamber;

a magazine well releasably mounted along the bottom surface of the receiver, the magazine well including a body having forward, rear and side portions, with a cavity defined therethrough;

a removable magazine configured to be at least partially received with the magazine well, the removable magazine containing a supply of ammunition and comprising a guide portion configured to direct the rounds of ammunition upwardly through the port of the receiver;

a feed ramp removably mounted within the magazine tube at a position forward of the magazine well and adjacent the chamber, the feed ramp configured to guide the rounds of ammunition from the magazine and toward the chamber, and comprising a body that is at least partially received within the magazine tube, wherein the feed ramp is made of a first material and the receiver is made of a second material, the first material having a higher impact toughness and/or strength in comparison to the second material; and a fastener passing through the magazine tube and the body of the feed ramp to locate and removably mount the feed ramp in the magazine tube.

* * * * *